United States Patent [19]

Westover

[11] Patent Number: 5,006,720

[45] Date of Patent: Apr. 9, 1991

[54] LIGHT SENSOR APPARATUS FOR SHEET TRANSPORT

[75] Inventor: Dwight G. Westover, Sierra Madre, Calif.

[73] Assignee: TransTechnology Corporation, Sherman Oaks, Calif.

[21] Appl. No.: 499,961

[22] Filed: Mar. 27, 1990

Related U.S. Application Data

[62] Division of Ser. No. 225,232, Jul. 28, 1988, Pat. No. 4,927,132.

[51] Int. Cl.[5] ..... G01N 21/86

[52] U.S. Cl. ..... 250/561; 250/223 R

[58] Field of Search ..... 250/561, 571, 222.1, 250/223 R, 221; 355/211

[56] References Cited

U.S. PATENT DOCUMENTS 4,501,480 2/1985 Matsui et al. ..... 250/571

4,597,665 7/1986 Galbraith et al. ..... 250/572

4,875,769 10/1989 Linebarger ..... 250/559

*Primary Examiner*—David C. Nelms

*Assistant Examiner*—K. Shami

*Attorney, Agent, or Firm*—David Weiss

[57] ABSTRACT

A light sensor device along a sheet transport track, having light emitting and sensing means in one of the track's two spaced apart walls, for emitting light energy and sensing the light energy reflected back from a sheet interposed between the walls and in the path of the emitted light energy. The sensor device also includes light absorbing means in the other wall of the track for absorbing the light energy emitted from the light emitting and sensing means when the sheet is not interposed between the light emitting and sensing means. The light absorbing means includes a transparent cylindrical member having a polished end surface for receiving the emitted light energy, the cylinder's other end surface and the cylinder's cylindrical surface being light energy absorbent.

5 Claims, 3 Drawing Sheets

LIGHT SENSOR APPARATUS FOR SHEET TRANSPORT

CROSS REFERENCE TO RELATED APPLICATION

This application is a division of co-pending U.S. Pat. application Ser. No. 07/225,232, filed July 28, 1988, now Pat. No. 4,927,132, issued May 22, 1990.

BACKGROUND OF THE INVENTION

This invention relates to document transport apparatus, and more particularly an improved light sensor device for sensing sheets or documents along a track.

In certain document processing systems it is necessary to load documents into document transport apparatus such that the documents are aligned in precise manner to facilitate subsequent reading of information contained on the documents and/or printing of information onto the documents. Such document loading apparatus, for example, is useful with transports for processing bank checks and merchant drafts, and for processing payments remitted by purchasers of goods and services.

In remittance processing systems, in particular, the loader device should be capable of rapidly and conveniently loading documents of various sizes and thicknesses, and of controllably aligning and advancing such documents into a main transport for processing. A typical transaction involved in remittance processing includes at least one check in payment of a customer bill or invoice along with a remittance coupon which is normally a returned portion of the invoice. Each of these documents contain machine readable data encoded thereon; the remittance coupon will normally include the customer's account number and the invoice amount, while the check will normally include the maker's bank and checking account numbers. The various functions performed by a remittance processing system may include the reading and storing of the machine readable data from both documents and/or the recording of video images of the documents including the machine readable data. From such data and other information obtained from the documents, the checks may be further imprinted with coded data representing the dollar amount of the check, the documents may be sorted, and various compilations of data may be prepared for further utilization.

Remittance processing systems include loader devices which permit documents to be vertically fed or hand-dropped by an operator into the loader, and which permit documents to be laterally fed into the loader by an automatic feeder apparatus. In either mode, the loader aligns or registers the bottom edge of the document along a registration surface of a track and then advances the document along the track. Such loaders permit the aligned document to be temporarily retained, or gated, prior to entering the system's main transport, by means for controllably blocking the loader's exit with a physical gate. When documents are automatically fed, further controllable means is normally provided by physically gating the document prior to its laterally entering the loader.

As the transports of remittance processing systems and automatic feeder apparatus increase in document throughput speed, the ability of prior art loaders to reliably keep pace becomes more difficult. Further, prior art loaders cannot generally accommodate documents of various thicknesses without adjustment being made to the loader, or documents of unusually narrow widths.

SUMMARY OF THE INVENTION

The inventions disclosed in the above referenced U.S. Pat. No. 4,927,132, the complete disclosure of which is incorporated herein by reference, include apparatus for loading documents into a transport in precise and reliable manner. The apparatus accommodates high speed transports, documents of various thicknesses and documents of unusually narrow widths. The apparatus includes novel document gating means which permits controlled gating of a document with reliability and response time suitable for high speed transports. The loader accommodates documents vertically dropped into the loader by an operator, as well as laterally fed documents issuing from an automatic feeder apparatus.

A feature of the inventions disclosed in U.S. Pat. No. 4,927,132 includes a preloader transport for applying documents to the loader issuing from the automatic feeder apparatus. A further aspect of the present inventions includes a track configuration for supporting the bottom edge of an upstanding document in such manner as to decrease the likelihood of document distortion while the document is being advanced along the track.

A still further feature of the apparatus of the inventions disclosed in U.S. Pat. No. 4,927,132, namely an improved light absorption device for combination with a reflective light sensor for sensing position of a document within the track, comprises the present invention claimed herein.

In the preferred embodiment of the loader apparatus, the track includes two spaced-apart upstanding walls obverse one another with a floor therebetween for supporting the document along the document's bottom edge, each wall having a groove along its bottom, the two grooves undercutting the walls such that the walls overhang the floor.

Briefly described, the improved light sensor apparatus according to the present invention comprises light emitting and sensing means in one of the track's two spaced-apart walls, for emitting light energy and sensing the light energy reflected back from a sheet or document interposed between the walls and in the path of the emitted light energy; and light absorbing means in the other wall for absorbing the light energy emitted from the light emitting and sensing means when the sheet or document is not interposed between the light emitting and sensing means and the light absorbing means, the light absorbing means including a transparent cylindrical member having a polished end surface for receiving the emitted light energy, the cylinder's other end surface and the cylinder's cylindrical surface being light energy absorbent.

BRIEF DESCRIPTION OF THE DRAWINGS

The novel features which are believed to be characteristic of the invention, together with further aspects and advantages thereof, will be better understood from the following description considered in connection with the accompanying drawings in which preferred embodiments of various aspects of the invention are illustrated by way of example. It is to be expressly understood, however, that the drawings are for the purpose of illustration and description only and are not intended as a definition of the limits of the invention.

DESCRIPTION OF THE PREFERRED EMBODIMENTS

Figure 1:
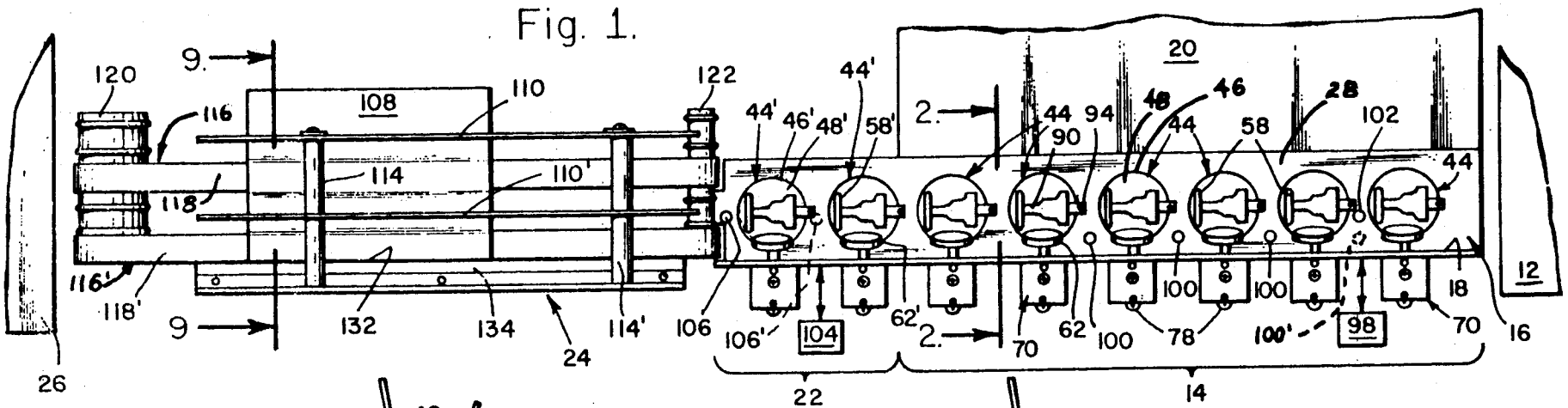
FIG. 1 is an elevation view of a document loader and preloader apparatus according to a preferred embodiment.

Turning first to FIG. 1, there is shown a preferred embodiment of document loading apparatus 10 for loading documents into a main transport of a document processing system 12. As used herein, a "document" refers to a generally rectangular sheet of paper or other flexible sheet usually containing information thereon, and further includes an envelope or carrier containing one or more of such sheets and usually having a transparent window for viewing the sheets contained therein.

The loading apparatus 10 includes a document receiving section 14 including a track 16 having a horizontally extending registration surface 18 (sec also FIGS. 2 and 3) for supporting upstanding documents along their respective bottom edges. A vertical entry section or drop guide 20 permits an operator to manually vertically enter or drop documents into the document receiving section 14. A lateral entry section 22 enables documents to be laterally fed into the receiving section 14 from a preloader transport 24, which laterally transports upstanding documents issuing from automatic document feeder apparatus 26. An example of an automatic document feeder apparatus is described in U.S. Pat. No. 4,723,773 incorporated herein by reference.

Figure 10:
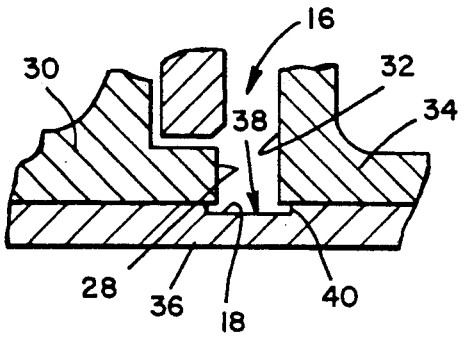
FIG. 10 is a side sectional view of a fragment of the loader apparatus, as in FIG. 3, showing in enlarged detail a preferred track configuration according to one aspect of the present invention.

The track 16 includes an upstanding support wall 28 of a support block 30, spaced from and facing an included upstanding guide wall 32 of a guide plate 34, the track 16 including a floor 18 (i.e. the track's registration surface 18) along a bottom plate 36 and between the two upstanding walls 28, 32. Preferably, the floor or registration surface 18 is formed along a longitudinal channel 38 undercutting the two upstanding walls 28, 32 such that the walls 28, 32 overhang the floor 18 by a distance equal to the depth of the channel 38, as more clearly shown in FIG. 10. The walls 28, 32 alternatively may be considered as each having a groove 40 along their respective bottom edges, the two grooves 40 undercutting the walls 28, 32 such that the walls 28, 32 overhang the floor 18 by a distance equal to the width (i.e. the vertical dimension) of the groove 40. An example of such distance is 0.015 inch, while the depth of the groove 40 may also be 0.015 inch. Without the undercut configuration of the track 16, the leading bottom corner of the advancing document 44 would tend to curl or wedge, and such curling or wedging is precluded by interference from the overhanging bottom edges of the walls 28, 32 when the document 44 is advancing along the registration surface 18. The result is a decreased likelihood of document jams both during loading and after the document has entered the main transport 12.

Advancement of each document for registration of the document's bottom edge along the preferably horizontally extending registration surface 18, for transporting the registered document along the track 16 for entering the document processing main transport 12, and for temporarily retaining or gating the document at specific locations along the track 16, are accomplished by means of controlled operation of a series of document driver devices 44, 44' spaced along the track 16.

The document loader apparatus 10 operates in either of two modes——i.e., manual vertically fed or "hand-drop" mode, and automatic laterally fed or "autofeed" mode. The disks 46, 46' and their respective disk surfaces 48, 48' are rotatably driven continuously in a counterclockwise direction during both modes of operation.

Figure 2:
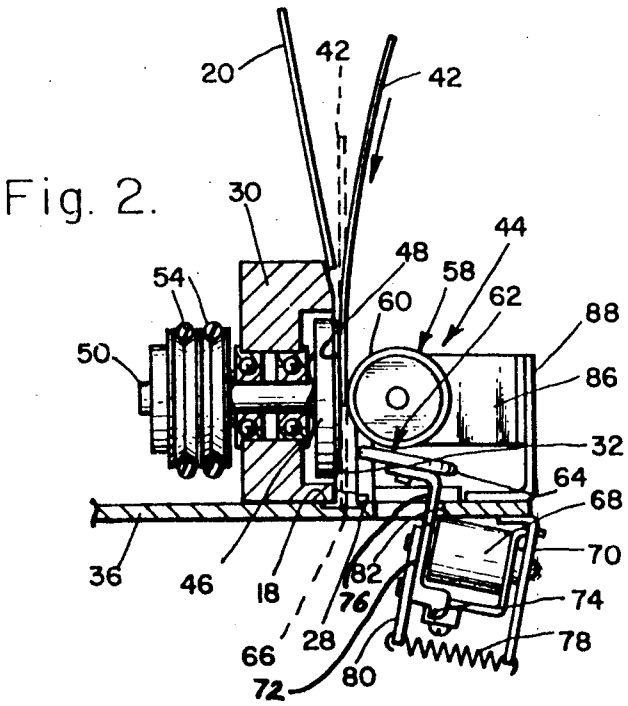
FIG. 2 is a side sectional view of a document driver device shown in FIG. 1, taken along the line 2—2 in the direction of the appended arrows, indicating both manual loading and gating of a document.

During the hand-drop mode, the upper first wheels 58 within the document receiving section 14 are initially in their active positions resiliently engaging their respective disk surfaces 48, while the lower second wheels 62 are in their inactive positions retracted from their respective disk surfaces 48, as shown in FIG. 2. As the document 42 is dropped into the vertical entry section 20, it will enter the document receiving section 14 and become interposed between at least two disk surfaces 48 and their associated engaged upper first wheels 58. The pressure applied by the upper wheels 58 (derived from their respective springs 94) will cause the counterclockwise rotating disk surfaces 48 to drive the document 42 downwardly within the track 16 toward the registration surface 18. As the document's bottom edge 66 advances toward the registration surface 18, the document 42 will trigger at least one of the three light sensor devices 100 arranged in spaced relation along and slightly above the registration surface 18.

Figure 11:
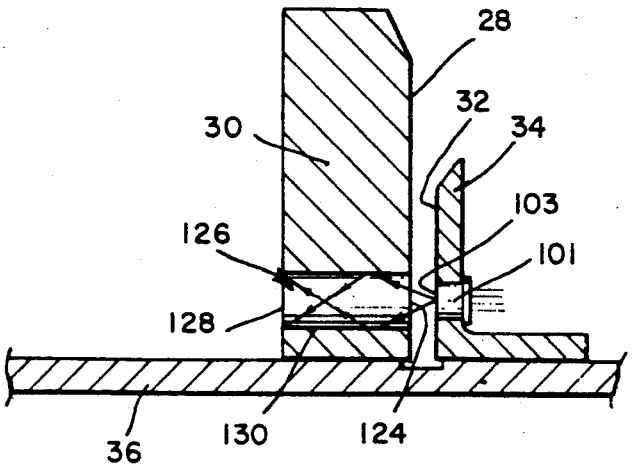
FIG. 11 is a side sectional view of a preferred embodiment of an improved light sensor arrangement according to the present invention.
Figure 12:
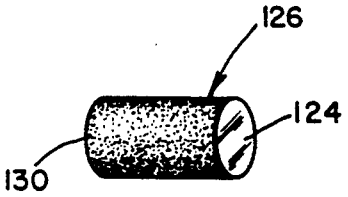
FIG. 12 is a perspective view of the light absorption portion of the light sensor arrangement shown in FIG. 11.

It is preferred that each light sensor device 100 include a reflective sensor 101 which provides both light emitting and sensing means, which is secured in the guide plate 34 as shown in FIG. 11. Each reflective sensor 101 has a flat face 103 mounted flush with the guide wall 32, permitting self cleaning of the sensor's face 103 by the advancing documents. The sensor 101 "looks into" a polished end 124 of a transparent cylindrical member 126 which is preferably made of acrylic such as sold under the trademark Lucite. The other end 128 and the cylindrical surface 132 of the transparent cylinder 124 are blackened so as to be light absorbent;

for example, the surfaces 128, 132 may be roughened and then painted flat black to provide a matte finish. The cylinder 126 is secured in the support block 30 with its longitudinal axis perpendicular to the face of the reflective sensor 101. The cylinder's transparent polished end surface 124 is flush with the support wall 28, providing a continuous support wall 28 in the vicinity of the light receiving face 124, thereby precluding these end surfaces 124 from being a source of document jams. In situations where the support wall 28 is not parallel to the face 103 of the reflective sensor 101, the transparent polished end 124 of the cylinder 126 need not be perpendicular to the longitudinal axis of the cylinder 126 but will instead conform to the support wall 28.

The reflective sensor 101 emits light which enters the light receiving cylinder 126 through the polished end 124 when a document is not interposed between the sensor 101 and the cylinder end 124. The light received by the cylinder 126 is scattered and finally absorbed by the blackened cylindrical surface 130 and the blackened end 128. When a document is interposed between the reflective light sensor 101 and the cylinder's polished end 124, the light energy is reflected back from the interposed document (which normally has a reflective surface and is usually opaque) and sensed by the sensor 101. The light absorbing cylinder 126 provided by this aspect of the present invention increases the reliability of the sensor 101 by providing a highly efficient means for absorbing emitted light and minimizing the light reflections in the absence of an interposed document.

Figure 3:
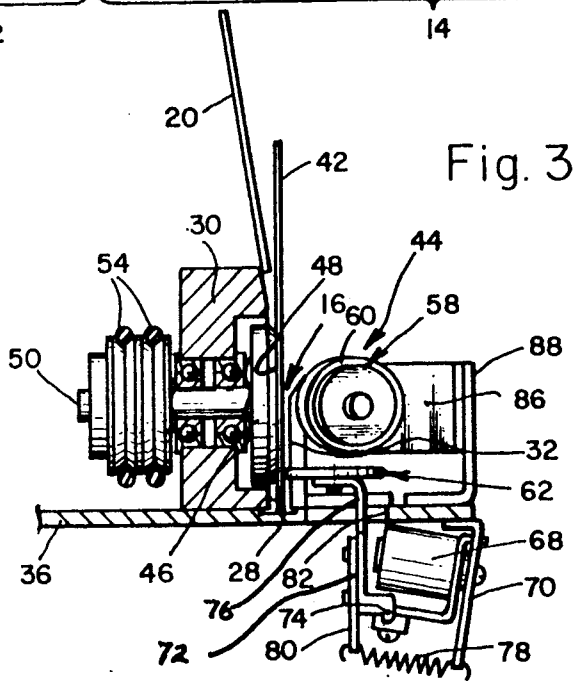
FIG. 3 is a side sectional view similar to FIG. 2, indicating lateral advancement of a document.
Figure 6:
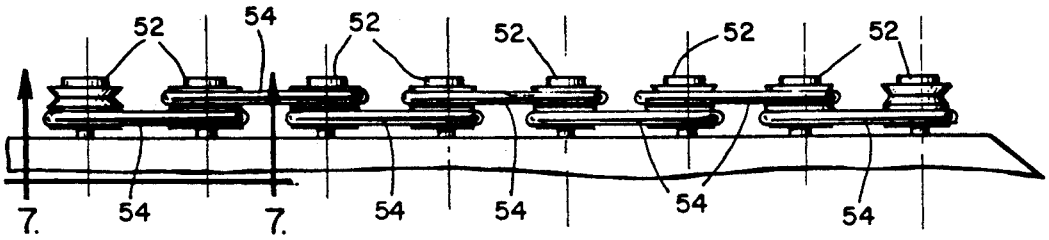
FIG. 6 is a plan view of a fragment of the loader apparatus of FIG. 1, indicating means for rotating the spaced rotatable disks of FIG. 1.
Figure 4:
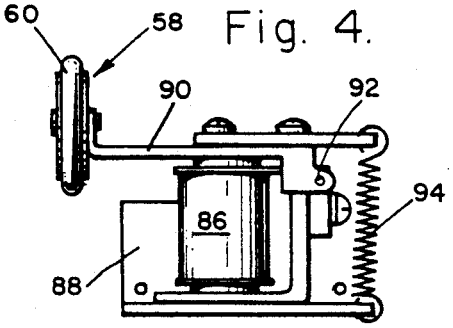
FIG. 4 is a plan view of the upper wheel arrangement shown in FIGS. 2 and 3.
Figure 5:
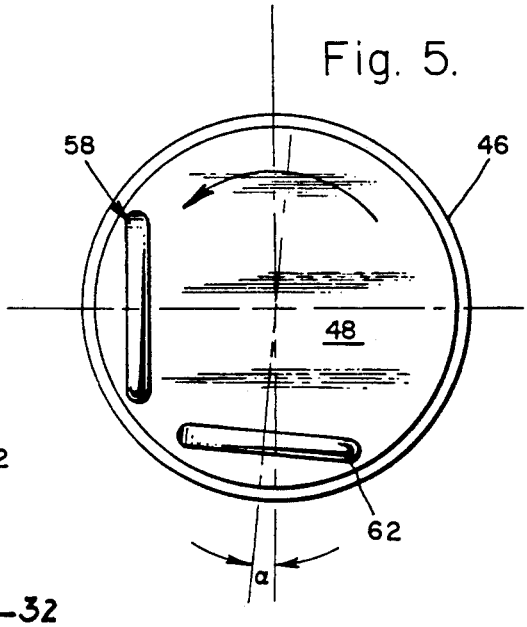
FIG. 5 is a diagramatic front elevation view of the document drive members of FIGS. 2 and 3.
Figure 7:
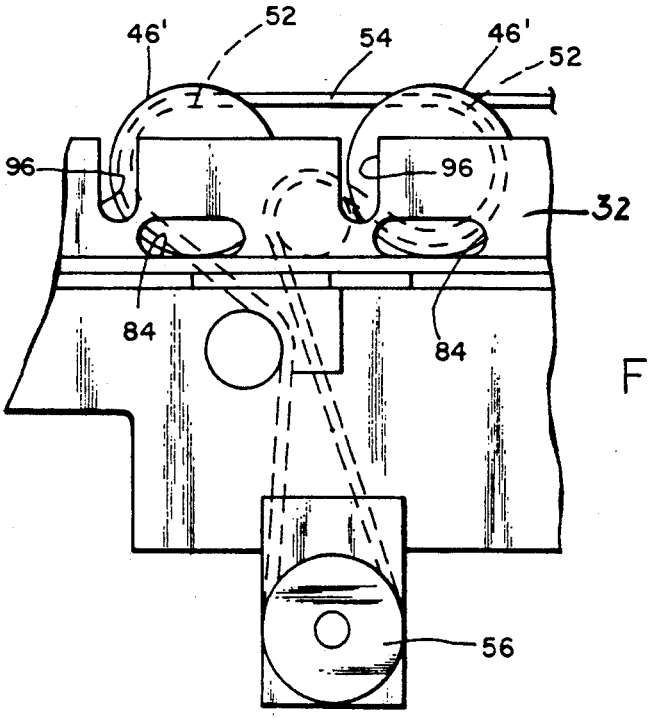
FIG. 7 is a fragment of the drive means of FIG. 6, taken along the line 7—7 in the direction of the appended arrows.

Returning to the operation of the loader 10 during the hand-drop mode, the upper first wheels 58 will remain in their active positions until any one of the three registration sensor devices 100 is blocked by an interposed document 42. Upon such occurrence, the first control means 98 will control energization of the solenoids 86 of the upper first wheels 58, and deenergization of the solenoids 68 of the lower second wheels 62, with a suitable decaying response time (for example approximately 1/64th second) for permitting continued downward driving such that the document's bottom edge 66 will be registered against the track's registration surface 18, and for assuring horizontal registration even of documents that are manually dropped into the receiving section 14 at an angle. The upper first wheels 58 retract to their inactive positions while the lower second wheels 62 engage to their active positions, as shown in FIG. 3. The pressure exerted by the lower wheels 62 upon the registered document 42 and to the counterclockwise rotating disk surfaces 48, through action of the springs 78, causes the engaged rotating disk surfaces 48 to advance the document along the track 16 toward the main transport 12. The 1½° skew of the lower wheels 62 assure that the document's bottom edge 66 remains in horizontal registration with the registration surface 18 as the document 42 is transported along the track 16.

When the leading edge of the forward advancing document 42 passes the exit sensor device 102 (which is similar to the sensor device 100 previously described) located within the track 16 just before the last disk 46 and at a height distant from the registration surface 18, the document 42 reflects the sensor emitted light into the reflective light sensor included in exit sensor device 102. The first control means 98 responds by controlling deenerization and energization of the solenoids 86, 68, respectively, for causing the upper first wheels 58 to assume their active positions and the lower second wheels 62 to assume their inactive positions, following a response time which permits the document 42 to be engaged by the last document driver device 44 of the plurality of such devices. The pressure exerted by the upper first wheels 58 in contact with the document 42 causes the associated disk surfaces 48 to urge the document 42 downwardly against the registration surface 18 while slipping against the document's back side, gating the document 42 prior to its exiting the document receiving section 14. When the main transport 12 is ready for the gated document, the first control means 98 controls the upper first wheels 58 to retract and the lower second wheels 62 to engage, applying pressure to the engaged rotating disk surfaces 48 which forwardly drive the document 42 into the main transport 12.

When entering the main transport 12, it is not uncommon for the document 42 to be initially driven by the main transport 12 at a slower speed than the speed by which the document is being driven by the loader 10. For example, an OCR reader or a video camera may be located at the beginning of the main transport 12, close to the exit of the loader 10. The loader 10 may be driving the document 42 into the OCR reader nip or the video camera nip at say 100 inches per second while the reader or camera nip is driving the document at say 20 inches per second. The rotating disk surfaces 48, which are in forward driving engagement with the document 42, slip against the document's backside as the document's forward speed is being restricted by the speed of the reader or camera nip at the entrance of the main transport 12, so that the document 42 is actually being driven at a speed of 20 inches per second. At the same time, the downward urging provided by the skew of the lower wheels 62 continues registration during the forward advancement of the document by the reader or camera nip, by preventing upward movement of the document's trailing edge.

Figure 8:
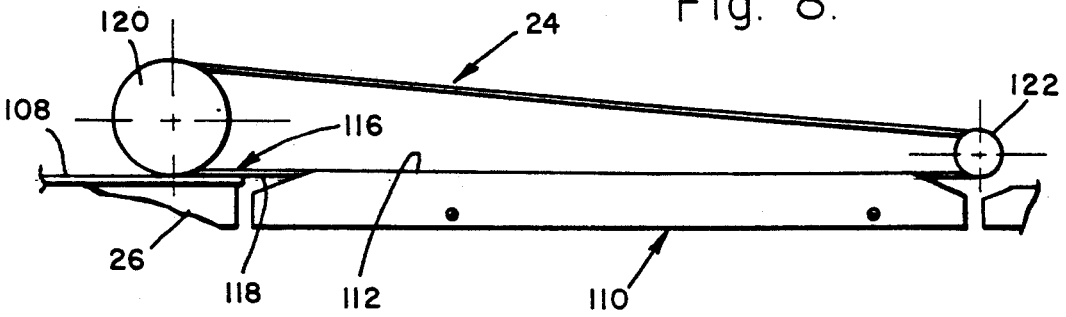
FIG. 8 is a plan view of the preloader transport shown in FIG. 1.
Figure 9:
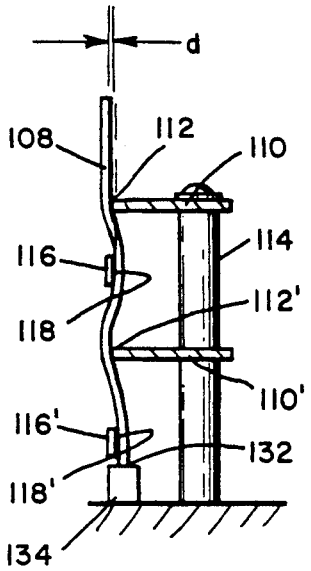
FIG. 9 is a side elevation view of the preloader transport of FIGS. 1 and 8, taken along the line 9—9 of FIG. 1 in the direction of the appended arrows, with an included document shown in exaggerated profile.

During the autofeed mode of operation of the loader 10, the lower second wheels 62 within the document receiving section 14 and the additional lower fourth wheels 62' within the lateral entry section 22 are normally in their active positions resiliently engaging their respective disk surfaces 48, 48' while the upper first wheels 58 and the upper third wheels 58' are normally in their inactive positions retracted from their respective disk surfaces 48, 48', as shown in FIG. 3. Referring to FIGS. 1, 8 and 9, the automatic lateral feeding device or "autofeeder" 26 ejects a document 108 into the preloader transport 24, with the document's back side engaging the drive belt surface 118, 118' and the document's front side engaging the plate edges 112, 112'. The bottom edge of the document 108 will generally ride upon, or at least be no lower than, a horizontal surface 132 of a preloader track 134, which surface 132 is preferably slightly higher than the registration surface 18. The drive belts 116, 116' are continuously driven during autofeed mode, and the laterally fed document 108 assumes a profile of the type exaggeratedly shown in FIG. 9 as it is laterally transported by the preloader transport 24 to the lateral entry section 22 of the loader 10.

When the leading edge of the laterally fed document 108 passes the entrance sensor device 106 (which is similar to the sensor device 100 previously described) located within the track 16 at the entrance of the lateral entry section 22 before the first of the additional disks 46' and at a height distant from the registration surface 18, the document 108 reflects the entrance sensor emitted light into the reflective light sensor included in the entrance sensor device 106. The second control means 104 responds by controlling deenergization and energization of the solenoids associated with the upper third wheels 58' and the lower fourth wheels 62', respectively, for causing the upper third wheels 58' to assume their active positions and the lower second wheels 62' to assume their inactive positions, following a suitable decaying response time (for example approximately 1/64th second) for permitting the document 108 to be engaged by the two driver devices 44' within the lateral entry section 22. The pressure exerted by the upper third wheels 58' in contact with at least the forward portion of the document 108 causes the associated disk surfaces 48' to gate the document 108 for preventing its entry into the document receiving section 14 while advancing the engaged portion of the document 108 downwardly toward the portion of the registration surface 18 within the lateral entry section 22. The rotating disk surfaces 48' continue to urge the engaged portion of the document 108 downwardly against the registration surface 18 while slipping against the document's back side. If the width of the document 108 is such that a portion of the document 108 remains in the preloader transport while the document is gated at the lateral entry section 22, the driven belt surfaces 118, 118' slip against the document's back side so that the preloader engaged portion of the gated document 108 remains supported as shown exaggerately in FIG. 9.

When the document receiving section 14 is ready to receive the gated document 108 (for example, in response to the preceding document's having fully entered the main transport 12 as sensed by the unblocking of the exit sensor device 102), the second control means 104 controls retraction of the upper third wheels 58' and engagement of the lower fourth wheels 62' for forwardly advancing the document 108 into the document receiving section 14 and into engagement with the rotating disk surfaces 48 and the active lower second wheels 62. As the document 108 forwardly advances, the $1\frac{1}{2}°$ skew of the lower wheels 62, 62' further horizontally registers the bottom edge of the document 108 against the registration surface 18.

When the leading edge of the forwardly advancing document 108 passes the exit sensor device 102, the document 108 is gated in the manner previously described with respect to gating of the vertically dropped document 42. This gating of a document prior to its entering the main transport 12 serves a second important purpose, particularly in the case of laterally fed documents 108, of horizontally registering the document if all of the previous registration procedures were insufficient to provide adequate registration.

As further assurance that adequate horizontal registration has been effected prior to a document's entering the main transport 12, the first control means 98 is responsive to the condition where no one of the registration sensor devices 100 is triggered (i.e. registration is not effected) while the more vertically situated exit sensor device 102 is triggered (i.e. a document is laterally positioned to exit the receiving section 14), for gating the document or for continuing the gating of the document——and the consequent downward advancement of the document——until one of the registration sensor devices 100 is triggered by being blocked by the interposed document.

Although the loader 10 is shown in FIG. 1 as including an upper or first wheel 58 associated with each of the rotating disks 46 within the document receiving section 14, the upper or first wheel 58 shown with the first disk 48 (i.e. the disk 46 farthest to the left within the document receiving section 14 as viewed in FIG. 1) is not necessary and may be omitted. In actual practice, documents are rarely if ever manually dropped into the receiving section 14 such that a portion of the document would be interposed between this first rotating disk 58 and an associated upper first wheel 58 if present.

During the hand-drop mode, it is preferred that the document be engaged simultaneously by at least two rotating disk surfaces 48 and their respective active upper first wheels 58 during the document's downward advancement. For laterally fed documents it is preferred that the document be engaged simultaneously by both additional rotating disk surfaces 48' and both active upper third wheels 58', when gating. Similarly, it is preferred that a document be engaged simultaneously by at least the last two rotating disk surfaces 48 in the document receiving section 14, and their respective active upper first disks 58, when gating.

It is further preferred that a forwardly advancing document, when possible, be engaged simultaneously by at least two active lower wheels (i.e. fourth wheels 62' or second wheels 62 or combinations thereof).

The preferred loader embodiment 10 of the present invention utilizes a total of eight rotating disks, there being two disks 46' within the lateral entry section 22 and six disks 46 within the document receiving section 14. Each disk 46, 46' is approximately $1\frac{1}{4}$ inches in diameter, and are spaced along the track 16 approximately $1\frac{3}{4}$ inches between their vertical centerlines.

The loader 10, as described thus far, accommodates documents having widths within a normal range, typically between four inches and nine inches. The loader 10 may be modified to also accommodate narrow width documents, i.e. documents having widths less than four inches but preferably greater than $2\frac{3}{4}$ inches.

The plurality of spaced document driver devices 44 in the receiving section 14, together with the use of three registration sensors situated between the second and third, the third and fourth, and the fourth and fifth disks 46 within the receiving section 14, permit documents having widths within the normal range to be vertically dropped anywhere within the document receiving section 14 and at document bottom edge drop angles up to approximately 30° from horizontal. In order to accommodate narrower documents, a fourth registration sensor device 100', similar to and operating in the same manner as the other three registration sensor devices 100, is situated between the fifth and sixth disks 46 within the receiving section 14 (below the exit sensor device 102). Further, a second entry sensor device 106', similar to and operating in the same manner as the entry sensor 106) is situated between the first and second disks 46' within the lateral entry section 22, permitting entry gating when either one of the sensor devices 106, 106' is triggered. In addition, it is preferred that the gating response time for narrow documents be faster than the gating response time for documents within the normal width range.

Thus there has been described a preferred embodiment of a document loader apparatus, including variations thereof, for accommodating both hand-dropped and automatically fed documents of various thicknesses and widths, together with a preloader transport for applying automatically fed documents to the loader, and specifically an improved light sensor device for increasing loader reliability and decreasing document jams. Other embodiments of the various aspects of the present invention, and modifications of the embodiments herein presented, may be developed without departing from the essential characteristics thereof. In addition, the preloader transport, the track configuration and the light sensor improvement may each be utilized in sheet transport apparatus other than document loading. Accordingly, the invention should be limited only by the scope of the claims listed below.

I claim:

1. In apparatus for receiving a sheet between two spaced apart walls, the improvement comprising:

light emitting and sensing means in one of said walls for emitting light energy and sensing said light energy reflected back from said sheet when interposed between said walls and in the path of said emitted light energy; and light absorbing means in the other of said walls for absorbing light energy emitted from said light emitting and sensing means when said sheet is not interposed between said light emitting and sensing means and said light receiving means, said light absorbing means including a transparent cylindrical member in said other wall and having a polished end surface for receiving said emitted light energy, said cylinder's other end surface and said cylinder's cylindrical surface being light energy absorbent.

2. The apparatus according to claim 1, above, wherein said polished end surface of said cylindrical member conforms to said other wall.

3. The apparatus according to claim 1, above, wherein said light emitting and sensing means has a face flush with said one wall.

4. The apparatus according to claim 1, above, wherein said polished end surface of said cylindrical member is flush with said other wall.

5. The apparatus according to claim 1, above, wherein said light emitting and sensing means has a face flush with said one wall and said polished end surface of said cylindrical member is flush with said other wall.

* * * * *

UNITED STATES PATENT AND TRADEMARK OFFICE

CERTIFICATE OF CORRECTION

PATENT NO. : 5,006,720

DATED : April 9, 1991

INVENTOR(S) : Dwight G. Westover

It is certified that error appears in the above-identified patent and that said Letters Patent is hereby corrected as shown below:

On the title page, in the References Cited section, add the following seven United States patents:

| | | | |
|---|---|---|---|
| -- | 3,532,338 | 10/1970 | Brinson et al. |
| | 3,614,091 | 10/1971 | Bernardis |
| | 3,770,265 | 11/1973 | Gatti |
| | 4,448,407 | 5/1984 | Bashford et al. |
| | 4,483,530 | 11/1984 | Spencer et al. |
| | 4,506,878 | 3/1985 | Bashford |
| | 4,522,385 | 6/1985 | Stefansson -- |

Column 2, line 21, "present" should be deleted.

Column 3, line 3, --thereof-- should be inserted before the semi-colon.

Signed and Sealed this

Sixth Day of October, 1992

*Attest:*

DOUGLAS B. COMER

*Attesting Officer*

*Acting Commissioner of Patents and Trademarks*